US006447356B1

(12) United States Patent
Lapointe

(10) Patent No.: US 6,447,356 B1
(45) Date of Patent: Sep. 10, 2002

(54) BUBBLE-MAKING TOY HAVING MULTIPLE COMPARTMENTS

(75) Inventor: Brian Lapointe, Rockport, MA (US)

(73) Assignee: Prime Time Toys Ltd. (HK)

( * ) Notice: Subject to any disclaimer, the term of this patent is extended or adjusted under 35 U.S.C. 154(b) by 0 days.

(21) Appl. No.: 09/602,365

(22) Filed: Jun. 22, 2000

(51) Int. Cl.[7] ..... A63H 33/28; A63H 3/00; A63H 3/52

(52) U.S. Cl. ..... 446/16; 446/15; 446/74; 446/267

(58) Field of Search ..... 446/15, 16, 17, 446/18, 19, 20, 21, 74, 267

(56) References Cited

U.S. PATENT DOCUMENTS

| | | | | |
|---|---|---|---|---|
| 1,397,162 A | * | 11/1921 | Dobbins | 446/20 |
| 2,154,652 A | | 4/1939 | Anderson | |
| 2,391,797 A | | 12/1945 | Raspet | |
| 2,631,404 A | * | 3/1953 | Clausen | 215/228 |
| 3,021,639 A | | 2/1962 | Allen et al. | |
| 3,579,898 A | * | 5/1971 | Hein | 446/16 |
| 3,733,736 A | | 5/1973 | Glessner, Sr. | |
| 3,736,694 A | * | 6/1973 | Lebensfeld | 446/16 |
| 3,845,583 A | * | 11/1974 | Ziff | 446/17 |
| 3,848,355 A | * | 11/1974 | Weight | 446/17 |
| 3,941,490 A | | 3/1976 | Anton | |
| 3,968,262 A | | 7/1976 | Hodska | |
| 3,968,784 A | | 7/1976 | Miller | |
| 4,299,049 A | | 11/1981 | Pimentel et al. | |
| 5,224,893 A | | 7/1993 | Routzong et al. | |
| 5,462,469 A | | 10/1995 | Lei | |
| 5,643,035 A | | 7/1997 | Freese et al. | |
| 5,839,936 A | * | 11/1998 | Lin | 446/16 |
| 6,039,213 A | * | 3/2000 | Sloan et al. | 222/192 |
| 6,241,571 B1 | * | 6/2001 | Chow | 446/16 |

* cited by examiner

*Primary Examiner*—Jacob K. Ackun
*Assistant Examiner*—Faye Francis
(74) *Attorney, Agent, or Firm*—Patterson, Thuente, Skaar & Christensen, P.A.

(57) ABSTRACT

A bubble-making toy provides a container structure having a main compartment for containing bubble solution and an outside compartment within which a bubble forming ring can be positioned. The main compartment and outside compartment can be opened to one another by way of a valve so that the bubble forming ring can be brought within the bubble solution and where the main compartment and outside compartment can be closed to one another during bubble generation by a user. Such a bubble-making toy reduces the possibility of bubble solution spillage during non use or storage of the bubble-making toy and during the time of bubble generation. Moreover, the design allows easy access of the bubble forming ring to the bubble solution. The provision of an adequately sized outside chamber also advantageously permits a bubble ring with a filling of bubble solution to be shielded until the time when a user intends to create a bubble. An actuator connected with the bubble forming ring is easily manipulated by a user that be used in opening and closing the valve provided between the main compartment and the outside compartment. A bias force is also preferably utilized to urge the valve toward a closed position between the main and outside compartments so that a normal closed position if provided to minimize spillage possibilities.

25 Claims, 4 Drawing Sheets

BUBBLE-MAKING TOY HAVING MULTIPLE COMPARTMENTS

FIELD OF THE INVENTION

The present invention relates to toys for blowing soap bubbles, and in particular to a spill resistant bubble-making toy where the bubble solution is provided within a closed container except when a bubble forming ring is dipped within the bubble solution for reducing the likelihood of spills.

BACKGROUND OF THE INVENTION

All sorts of bubble making devices have been developed and designed so as to provide an aesthetically pleasing toy which functions in the making of bubbles from bubble solution, such as soap bubbles from a soap solution. Such toys are known to be shaped in many different ways to simulate objects such as, for example, guns or to resemble animals or other creatures. Such design shapes are important in making an aesthetically pleasing play toy. See, for example, U.S. Pat. No. 3,736,694 to Lebensfeld; U.S. Pat. No. 4,299,049 to Piementel et al.; U.S. Pat. No. 3,021,639 to Allen et al. and U.S. Pat. No. 3,733,736 to Glessner, Sr. as examples of bubble-making toys having designs for aesthetic purposes.

Bubble-making toys of such designs and other more functional designs are known to be provided with numerous mechanisms for making bubbles. The simplest design is a wire or plastic frame having an enclosed portion, such as a circle, which is dipped into bubble-making solution in a container. Bubbles are then produced by a person blowing into the enclosed portion. Such enclosed portions are known to be made of various shapes and sizes so as to produce many different sizes of bubbles and/or multiple bubbles at the same time. Other mechanisms are also provided for generating an airflow so that a person does not need to generate the air utilized in blowing a bubble. See, for example, the Piementel et al. patent noted above and U.S. Pat. No. 5,643,035 to Freese et al. The aforementioned Allen et al. patent includes a mechanism providing multiple film forming devices by which the bubbles are formed so that a continuous stream of bubbles can be generated.

Of such bubble-making toys, those that require a person to generate the air flow for making a bubble are generally prone to having bubble solution spill from the container if the container is not held substantially upright. That is because access must be provided to the bubble solution so that the bubble forming ring or device can be immersed within the bubble forming solution and moved to a position accessible to a user to receive generated air flow. The accessibility to a person for receiving the generated air flow requires that the container holding the bubble solution must be open. In the Allen et al., device the bubble solution is retained within a reservoir that is open through the mouth portion of the ornamental fish design. A more sophisticated bubble blowing toy is described in the Lebensfeld patent where some of the bubble solution is stored within the main body of the container, while a smaller quantity of solution is retained in an upper reservoir, which for bubble blowing action requires that the upper reservoir be open. The upper and main containers are in fluid connection so that solution is transferable between them, and in particular, to maintain a minimal supply within the upper reservoir. This design minimizes spillage in that the upper container can be replenished with bubble solution but yet be holding only a small quantity of bubble solution as compared to the quantity stored within the main container portion.

Another bubble forming device is described in U.S. Pat. No. 2,631,404 to Clausen. In order to minimize bubble solution leakage, a movable member having a bubble forming opening is provided that is biased to a position within the interior of the bubble solution container. The movable member is formed with an integral cover member so that when the bubble forming member is in its biased position, the cover closes the bubble solution container. To produce bubbles, a rod is utilized to move the member from a position immersed within the solution of the container so that the cover is moved away from the container opening until the bubble forming opening is provided in position above the container for receiving generated air to produce a bubble. During the bubble blowing position, the container is opened whereby bubble solution is susceptible to being spilled.

SUMMARY OF THE PRESENT INVENTION

The present invention overcomes the disadvantages and short comings of prior art bubble-making toy devices by providing a container structure having a main compartment for containing bubble solution and an outside compartment within which a bubble forming ring can be positioned, and where the main compartment and outside compartment can be opened to one another by way of a valve so that the bubble forming ring can be brought within the bubble solution and where the main compartment and outside compartment can be closed to one another during bubble generation by a user.

Such a bubble-making toy in accordance with the present invention advantageously reduces the possibility of bubble solution spillage during non use or storage of the bubble-making toy and during the time of bubble generation. By using a valve having a positive closing bias or force, devices in accordance with the present invention are not only auto-closing, but they are better suited for long term storage because the bubble solution is less likely to dry out. Not only are the designs of the present invention substantially non-spill, they are less messy in that drips from the bubble forming ring are caught and permitted to flow back into the container. Moreover, the design allows easy access of the bubble forming ring to the bubble solution. The bubble forming ring is also advantageously substantially self-contained with the container so as to reduce the likelihood of losing the bubble forming ring. The provision of an adequately sized outside chamber also advantageously permits a bubble ring with a filling of bubble solution to be shielded until the time when a user intends to create a bubble.

In particular, an actuator connected with the bubble forming ring which is easily manipulated by a user can be provided. The actuator can also advantageously be used in opening and closing a valve provided between the main compartment and the outside compartment. A biasing means is also preferably utilized to urge the valve toward a closed position between the main and outside compartments.

The advantages of the present invention can be achieved by a spill resistant bubble-making toy comprising a container having a main compartment for receiving and holding a quantity of bubble solution, a divider structure including an outside compartment defining portion having an access opening positioned to permit access between the main compartment and the outside compartment, a valve operatively positioned for selectively opening and closing the access opening, and an actuator movably disposed relative to the outside compartment and including a bubble forming ring, the actuator having a first portion for manipulation by a user and by which a user can move the actuator and thus the bubble forming ring and a second portion for engagement with the valve for opening the valve and permitting the bubble forming ring to be disposed within the main compartment. Preferably, the valve is biased toward the outside compartment defining portion of the divider structure so that the valve closes the access opening under the biasing force. The divider structure may further comprise a top portion that supports the outside compartment defining portion and that closes the main compartment of the container.

Preferably, the actuator extends through the valve and in the direction of its movement sufficiently so that the bubble forming ring can be positioned beyond the top portion of the divider structure, and the actuator second portion comprises a shoulder portion for engagement with the valve as the actuator is moved in a first direction, and the actuator is otherwise movable within the passage of the valve. The shoulder portion may be spaced from the valve when the bubble forming ring is positioned beyond the top portion so that the shoulder engages the valve only after the actuator is moved in the first direction by a distance where a portion of the bubble forming ring is within the outside compartment volume. The valve is preferably openable against the bias force of the valve by continued movement in the first direction of the actuator after engagement of the shoulder with the valve, and the valve is closeable under the influence of its bias force upon movement of the actuator in a second direction opposite to the first direction after the valve is opened. The bubble-making toy can be sized and configured so that a quantity of bubble solution can be stored within the main compartment below the valve and outside compartment and so that the valve and bubble forming ring can be positioned within bubble solution when stored within the main compartment by movement of the actuator in the first direction. More preferably, the actuator extends in the first direction so as to further pass through a passage of the container by way of a wet seal that permits the actuator to move in its first and second directions so that the first portion of the actuator is provided below the container.

In accordance with a preferred embodiment of the present invention, the bubble-making toy has an ornamental external surface that may be shaped as an object or creature. For example, the container can be sized and shaped and provided with an ornamental external surface to simulate an ice cream cone.

Another aspect of the present invention is a method for making bubbles by such a spill resistant bubble-making toy, the method comprising the steps of providing a container that is divided into plural compartments including at least a main compartment having a quantity of bubble solution therein and an outside compartment that is open to outside of the container and openable and closeable to the main compartment by a valve; providing an actuator having a first portion for manipulation by a user and a bubble forming ring; manipulating the actuator to move the bubble forming ring in a first direction from the outside compartment to within the main compartment after opening the valve; immersing the bubble forming ring within the bubble solution while the valve is open for picking up a film of bubble solution on the bubble forming ring; further manipulating the actuator to move the bubble forming ring in a second direction that is opposite to the first direction from within the bubble solution in the main compartment, through the outside compartment and from the container for access to a user; closing the valve; and directing a fluid flow toward the bubble forming ring.

Preferably, the step of manipulating the actuator to move the bubble forming ring within the main compartment comprises the actuator engaging the valve and then opening the valve by continued movement of the actuator in the first direction, and after such engagement, moving the bubble forming ring into the main compartment by the continued actuator movement in the first direction. The step of manipulating the actuator to move the bubble forming ring within the main compartment may also include moving the actuator relative to the valve for a distance in the first direction before a second portion of the actuator engages with the valve. Preferably, the bubble forming ring is moved to be positioned within the outside compartment before the valve is opened, the bubble forming ring is moved to be positioned within the main compartment by the actuator opening the valve against a bias force that urges the valve to a closed position of the outside compartment to the main compartment, the bubble forming ring is moved back into the outside compartment after it is immersed in bubble solution by moving the actuator in the second direction and after the valve is closed under the influence of the bias force, and continued movement of the bubble forming ring from the outside compartment after it is immersed occurs while the valve is kept in a closed position.

DETAILED DESCRIPTION OF THE PREFERRED EMBODIMENT

Figure 1:
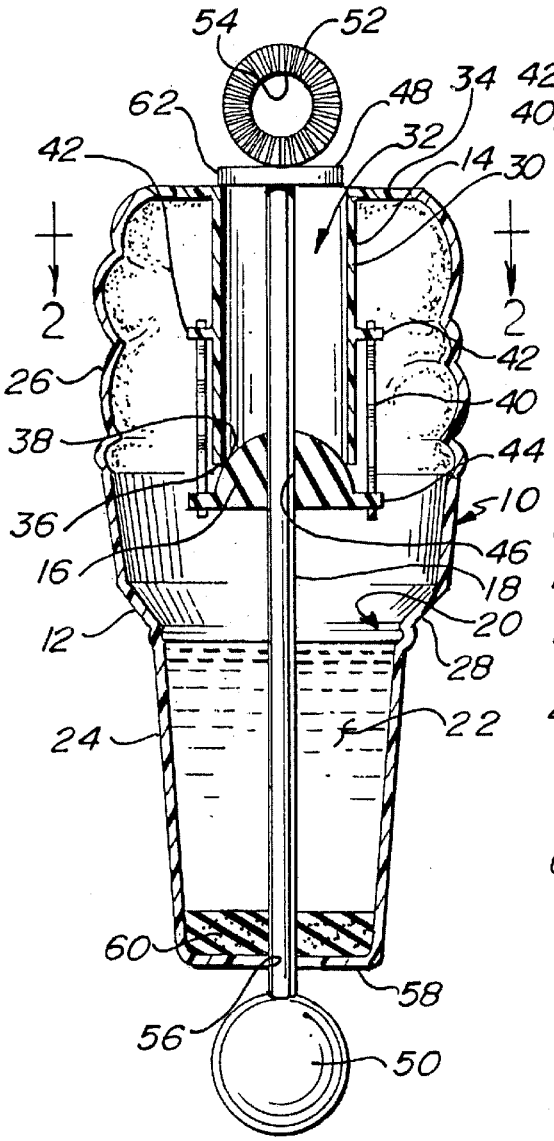
FIG. 1 is a cross-sectional view in elevation of one embodiment of a bubble-making toy in accordance with the present invention showing an actuator in a first position with the valve closed between the main and outer compartments.

With reference to the Figures wherein like components are labeled with like numerals throughout the set of Figures, a bubble-making toy 10 is illustrated in FIG. 1 that generally comprises a container 12, a divider structure 14, a valve 16 and an actuator 18. The container 12 defines a main compartment 20 within which a quantity of bubble solution 22 can be provided and stored. The bubble solution 22 may comprise any known or developed solution suitable for the purpose of making bubbles such as any known or developed soap solution.

The container 12 is preferably shaped to have a lower portion 24 and an upper portion 26 as connected by a transition portion 28. Preferably, the lower portion 24 is shaped and sized to be easily gripped by the hand of an operator, especially that of a small child. The upper portion 26 is preferably larger in transverse cross section than the lower portion 24 so as to easily accommodate the divider structure 14, described more in detail below. The transition portion 28 provides the connective region between the two differently sized lower portion 24 and upper portion 26.

The shape of the container 12 is not of particular importance other than it should define a main compartment 20 sufficient to hold a desirable quantity of bubble solution 22 but yet provide the volume within which a divider structure 14 can be provided as set out below. The container 12 need not be sectioned into upper and lower portions as illustrated, nor include any transition area at all. The container may be cylindrical, rectangular or square in cross section, or of just about any other shape provided that the main compartment 20 is defined for the functional reasons noted above. Further functional aspects with regard to permitting movement and positioning of the divider structure 14, valve 16 and actuator 18 are also noted below.

Figure 8:
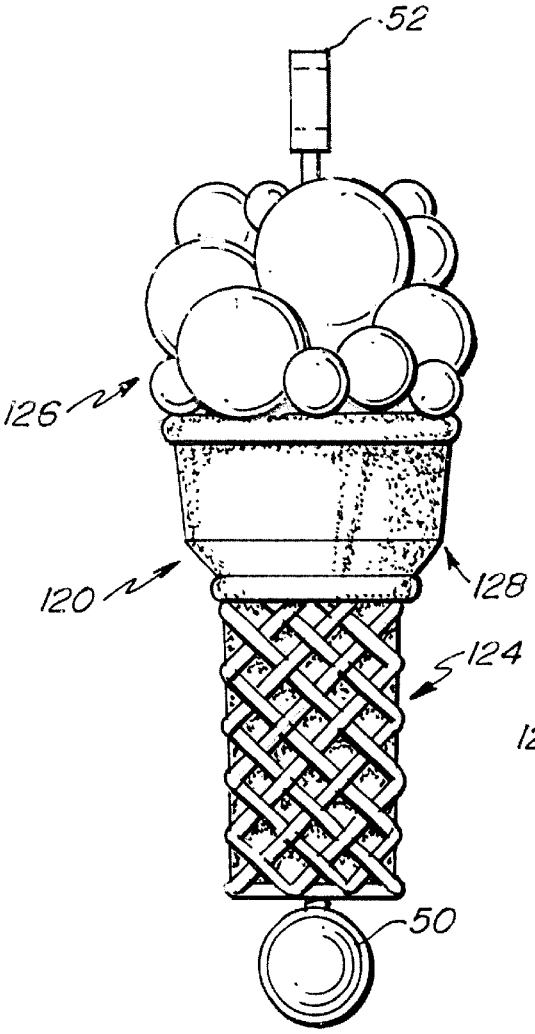
FIG. 8 is a side elevation view of an ornamental bubble-making toy in accordance with the present invention having the compartments and characteristics in accordance with the present invention and provided in the shape of an ice cream cone.
Figure 9:
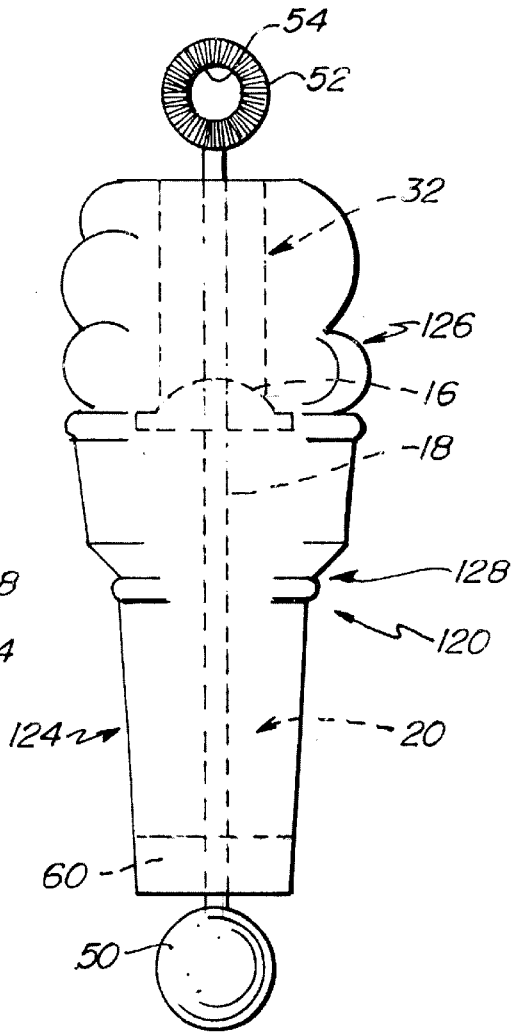
FIG. 9 is a side elevation view of the ornamental device of FIG. 7, but with the actuator, valve and outer compartment shown in phantom.
Figure 2:
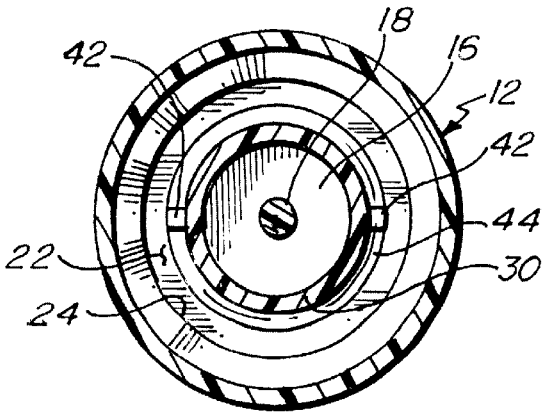
FIG. 2 is a cross-sectional view taken along line 2—2 in FIG. 1 showing the valve closed below the outer compartment and surrounded by the main compartment.
Figure 7:
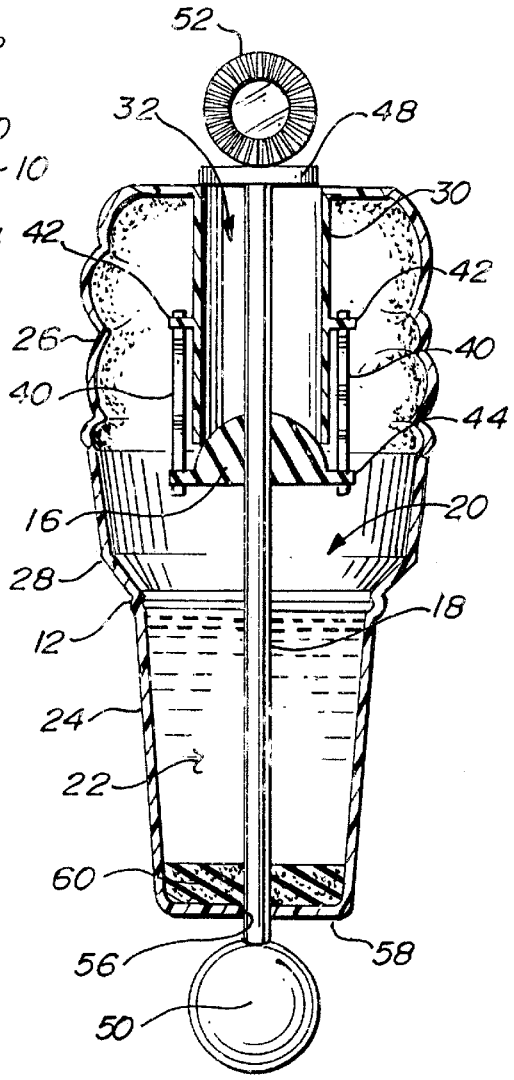
FIG. 7 is the same view as FIG. 1 where the bubble forming ring is positioned above the outer compartment and the main compartment to provide access for producing a bubble from the film of bubble solution additionally illustrated within the bubble forming ring.

It is further contemplated that the container 12 may be ornamentally provided. That is, in addition to be sized and shaped, the container 12 may be ornamentally decorated or provided with surface features to resemble any object or creature in order to enhance the attractiveness of the toy to users, such as children in particular. As a specific example, an ice cream cone container is illustrated in FIGS. 7 and 8. Specifically, the ice cream cone container 120 can be provided in accordance with the general shape of container 12 with upper and lower portions 26 and 24, respectively of FIG. 1. Specifically, an upper region 126 is illustrated to resemble balls of ice cream provided atop an ice cream cone formed partially from the upper region 126 and the smaller lower region 124. A transition portion 128 further provides part of the cone shape. The external surface appearance may be provided by any known means, such as by providing three dimensional surface features and/or by utilizing any number of colors or textures and the like. The container 120 may be molded to provide its features and/or colors and textures or may include multiple components fitted together in any conventional way. For example, the container may be provided similar to that shown in FIG. 1 onto which external ornamental features can be added by other components and coloring material. Conventional fasteners and/or adhesives and the like may be further utilized as needed. Moreover, the container 120 may be made of any suitable material conventional or further developed including different materials used together or a single material as the entire container.

The divider structure 14 is preferably provided within the volume defined by the container 12. It should, however, be provided so that when the container 12 is held in a position for receiving and holding bubble solution 22 (usually upright), the divider structure 14 will be above the bubble solution 22 under normal forces. In particular, a tubular portion 30 of the divider structure 14 is preferably operatively positioned within the volume of the container 12 so as to define an outside compartment 32 in addition to the main compartment 20. The tubular portion 30 may be operably positioned within the container 12 by any suitable structure and to define the outside compartment 32. Preferably, the tubular portion 30 is formed with or connected with a top portion 34 that not only connects the tubular portion 30 to the container 12, but also closes and seals the main compartment 20. The tubular portion 30 may be in the form of a hollow cylinder as illustrated, or in any desired shape within which any desired shape of an outside compartment 32 can be defined. Moreover, the tubular portion 30 may be supported anywhere within the volume of container 12, such as off center or at different levels within the elevation of container 12. The tubular portion 30 may otherwise be supported wholly or partially outside of the volume of container 12 so as to define an outside compartment 32 above or partially above the main compartment 20.

A lower edge 36 of the tubular portion 30 is closeable by the valve 16 so as to effectively close the outside compartment 32 from the main compartment 20. That is, the lower edge 36 acts as a valve seat. Surface 38 of valve 16 is preferably urged into engagement with the lower edge 36 of the tubular portion 30 by a biasing means 40 that is schematically illustrated in FIG. 1. The biasing mean 40 may comprise any known or developed element or mechanism or other force generating system for urging the valve 16 toward the lower edge 36 but which permits the valve 16 to move away from the lower edge 36 pursuant to an applied force. The biasing means 40 is schematically illustrated as an expansion-type biasing means that is operatively connected between tabs 42 connected with the tubular portion 30 and edge portion 44 of the valve 16. Such an expansion-type bias means may be connected in other arrangements and with other components. Alternatively, a compression-type bias means can be utilized, such as operatively acting between any portion of the container lower than the valve 16 and the valve 16. Any number of such biasing elements or mechanisms may be provided. As another example, the biasing means 40 could comprise a resilient bellows that surrounds the tubular portion 30 and acts in the same way as an expansion spring. Such a design may provide additional benefits in reducing spillage.

Valve 16 itself may be made of any conventional or developed materials suitable for effectively closing the outer compartment 32 from the main compartment 20. For example, resilient and/or conformable materials, such as natural or synthetic rubbers and/or vinyls, may be used so as to enhance the closing of outside chamber 32 under the influence of the bias force generated by biasing means 40. Other materials such as polymeric materials and blends and copolymers thereof, for example nylon, teflon, and the like, may be suitable. Valve 16 may be comprised of a single material or may include multiple materials blended together or formed in distinct portions of the valve 16 or the like, for providing structural integrity and functional aspects of the valve 16.

Valve 16 preferably also includes a passage 46 through which the actuator 18 can pass freely. That is, it is preferable that actuator 18 can be moveable in its longitudinal direction through valve 16 within at least a desired range. That range is preferably limited on the one end by a shoulder 48 fixed with the actuator 18, preferably near its upper end, and at the other extreme by a handle 50 that is provided for easy manipulation of the actuator 18 by a user. At the end of the actuator 18, adjacent shoulder 48, a bubble forming ring 52 is preferably provided. The bubble forming ring 52 preferably comprises a closed structure about an opening 54 suitable to facilitate the making of a bubble from the bubble solution 22. The bubble forming ring 52 may be substantially round as illustrated, or any other shape as known or developed and may include known or developed features to facilitate the forming of the bubbles from the bubble solution 22. Moreover, multiple bubble forming rings 52 may be provided, or a single ring may be divided into same or dissimilar bubble forming structures.

The passage 46 may alternatively frictionally engage the actuator 18 so as to cause the actuator 18 and valve 16 to move together unless and until a threshold resistance is encountered. That is, the valve 16 may move with the actuator 18 by frictional engagement until the biasing means 40 is fully extended or compressed or otherwise limited. Or, whenever the biasing means 40 creates a sufficient resistance force in opposition to the direction of movement of the valve 16. Further movement of the actuator 18 after such a threshold resistance is encountered would then be permitted by the actuator 18 sliding within the passage 46 of valve 16. The operation of such an actuator 18 and valve 16 would be similar to that described below, except that the opening and closing times may be different relative to the movement of the actuator 18. For example, the valve 16 could open sooner with the bubble forming ring 52 moving relative to the valve 16 after it is opened.

The actuator 18 is preferably dimensioned to be sufficiently long to pass through a passage 56 provided through a bottom wall 58 of the container 12. Passage 56 preferably permits both axial and radial movement of the actuator 18 relative to the container 12, but may include radially limiting features to prevent rotation of the actuator 18, if desired. In order to prevent the bubble solution 22 from also passing through the passage 56 through bottom wall 58, a wet seal 60 is further preferably provided Wet seal 60 may comprise any known or developed structural sealing element that also freely permits actuator 18 to move at least axially through it and/or it may comprise any conventional or developed sealing material deposited within the bottom of container 12. The sealing element or material comprising the wet seal 60 should effectively seal the actuator 18 with the container 12 while permitting relative movement between the two. Preferably, the wet seal 60 may comprise, in particular, resilient closed-cell foams produced from polyolefins and copolymers thereof in that they can provide an effective wet seal but permit the actuator movement. For example, a closed cell polyethylene and EVA foam that is commercially available as EV-50, form Zotefoams Inc. of Florence, Ky. can be utilized to provided a sealing element placed within the container bottom and provided with an opening sized to snugly permit movement of the actuator 18.

As noted above, the actuator 18 is freely moveable with respect to the valve 16 and container 12 in the axial direction of actuator 18 as preferably limited by the shoulder 48 and handle 50. As shown in FIG. 1, the handle 50 limits the upward movement of the actuator 18 only after the bubble forming ring 52 is positioned above the top end 62 of the top portion 34 that closes container 12. This position facilitates the making of bubbles by the bubble forming ring 52 when subjected to air flow directed through the opening 54 when a film of bubble solution is provided across the opening 54. Shoulder 48 limits the downward movement of the actuator 18 as viewed in FIG. 1, by way of valve 16, biasing means 40 and tubular portion 30. In particular, when the actuator 18 is moved downwardly, such as by manipulating handle 50, shoulder 48 comes into contact with valve 18, which had therebefore permitted free axial movement of actuator 18 through its passage 46. Upon contact of shoulder 48 with the furthest extent of valve 16, valve 16 is opened by the continued application of force to the actuator 18 against the force of biasing means 40. Preferably, the force generated by the biasing means 40 is sufficient to maintain an effective seal when valve 16 is positioned against the lower end 36 of tubular portion 30, but sufficiently weak to permit the easy opening of valve 16 from the lower end 36 as manipulated by a user, such as a small child. In any case, once the limit of movement of valve 16 is reached under the guide of the biasing means 40, valve 16 movement is stopped, thus stopping further movement of actuator 18 by way of its engagement with shoulder 48.

It is illustrated in FIG. 1 that the shoulder 48 is positioned adjacent to the bubble forming ring 52 so that the valve 16 will not be opened against the bias force until the bubble forming ring 52 is well within the outside compartment 32. Valve 16 may be opened before the bubble forming ring is withdrawn, or even partially withdrawn, into the outside compartment 32. Preferably, the bubble forming ring 52 is fully withdrawn the outside compartment 32 prior to the valve 16 being opened. Moreover, the extent of withdraw is also dependent on the length of the tubular portion 30 of the divided structure 14 in the axial direction of the actuator 18. This axial extent may range from merely the thickness of the top portion 34 to as far as desired almost completely to the wet seal 60 within container 12. Some or all of the extent of tubular portion 30 may be above the volume of the container 12. It is preferable, however, that the extent within container 12 be limited to permit at least the full dimension of the bubble forming ring 52 to be positioned within the volume of the container 12 below the divider structure 14 as to pick up bubble solution 22. More preferably, sufficient space should be provided to facilitate the size of valve 16 as well as the size of the bubble forming ring 52. Most preferably, the extent is limited so as to provide holding volume for a sufficient quantity of bubble solution 22 so that repeated bubble forming processes can be performed where bubble solution is effectively provided as a film across the opening 54 of the bubble forming ring 52.

Many other configurations are contemplated in accordance with the present invention where a container 12 is divided into a main chamber 22 and an outside chamber 32 by a movable valve 16 and divider structure 14. That is, in accordance with any of the suggested features and modifications discussed above, the actuator 18 may, for example, be otherwise configured. The actuator may instead be provided from above the bubble forming ring 52. In this case, the actuator would be manipulated from above and could be slideably connected with the valve 16 so that the valve 16 could be opened after the bubble forming ring is lowered to some degree to provide the ability to pick up bubble forming solution 22 from the lower container. The actuator 18 may otherwise be manipulated by an element provided through the container side. Appropriate slots may be provided within the tubular portion 30 and container side walls.

It is further contemplated that multiple actuators 18 in any of the suggested configurations may be used together. Specifically, more than one bubble forming ring 52 may be manipulated with respect to a single container 12. In this case, multiple actuators may move bubble forming rings within a single outside compartment 32, or multiple distinct outside compartment 32 may be provided each of which facilitates one or more bubble forming ring.

The operation of the embodiment illustrated in FIG. 1 is described as follows with reference to FIGS. 1 and 3 through 6. Starting at the position illustrated in FIG. 1 of actuator 18, the bubble forming ring 52 is positioned above the top surface 62 of the top portion 34 that positions the tubular portion 30 in place. Shoulder 48 is shown positioned also above the top surface 62. Handle 50 provides the limit of upward movement of the actuator 18.

Figure 3:
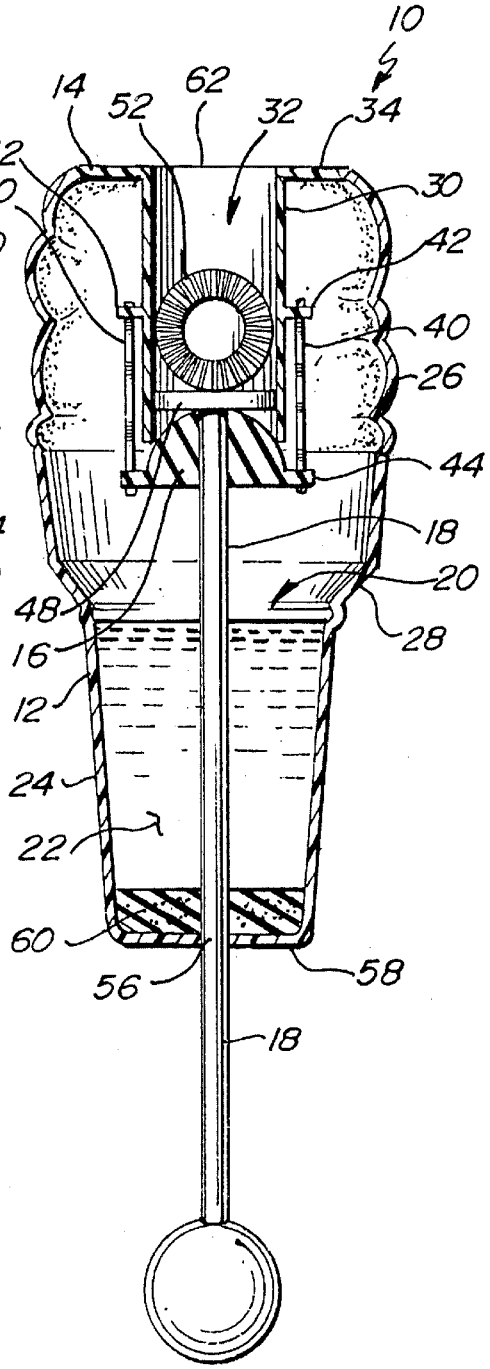
FIG. 3 is a similar view as FIG. 1 but with the actuator in a partially lowered position and the valve still closed while the bubble forming ring is positioned within the outer compartment.
Figure 4:
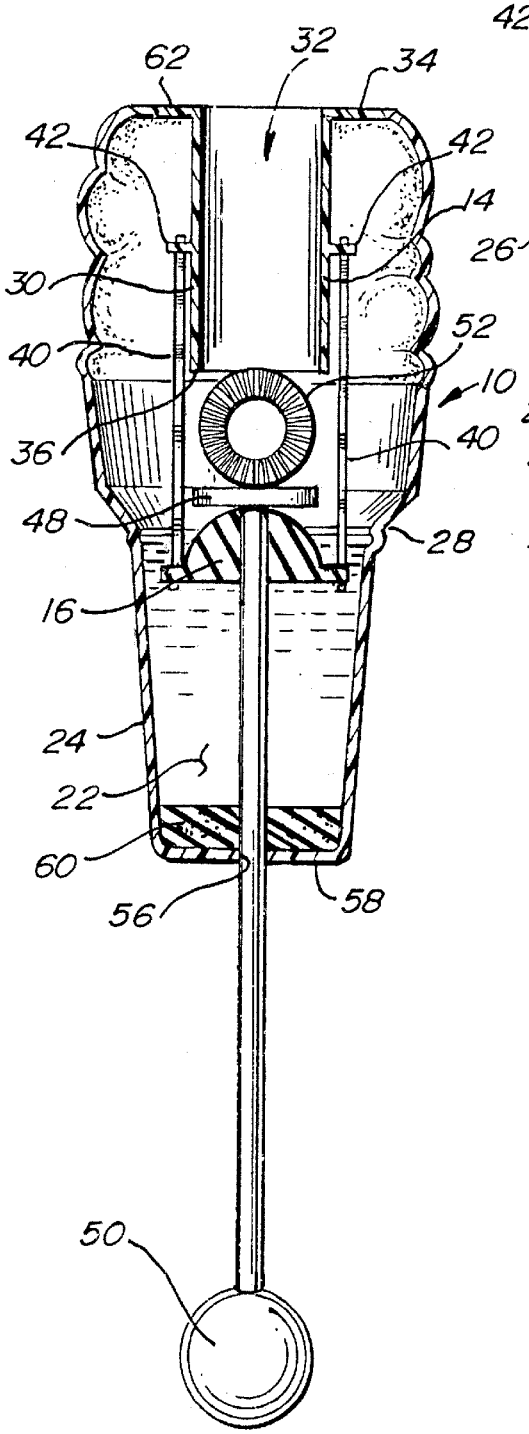
FIG. 4 is a view similar to FIGS. 1 and 3 but showing the actuator in a further partially lowered position sufficient to open the valve between the main compartment and outer compartment with the bubble forming ring lowered into the main compartment.

In FIG. 3, the shoulder 48 is shown at its position where it abuts the upper extremity of valve 16. Actuator 18 has been axially shifted so that it has moved by the distance from the shoulder's upper position to its position against valve 16 through valve 16 and through passage 56 of the bottom wall 58 of container 12. At this point, the biasing means 40 is not subjected to an external force against its bias direction. The bubble forming ring is now located within the outside compartment 32, which is still closed from the main compartment 20. Further axial manipulation of actuator 18 is illustrated in FIG. 4. Valve 16 is moved against the urging of biasing means 40 by the force applied through actuator 18, shoulder 48 and the valve 16. At this point, the outside compartment 32 and main compartment 20 are open to one another.

Figure 5:
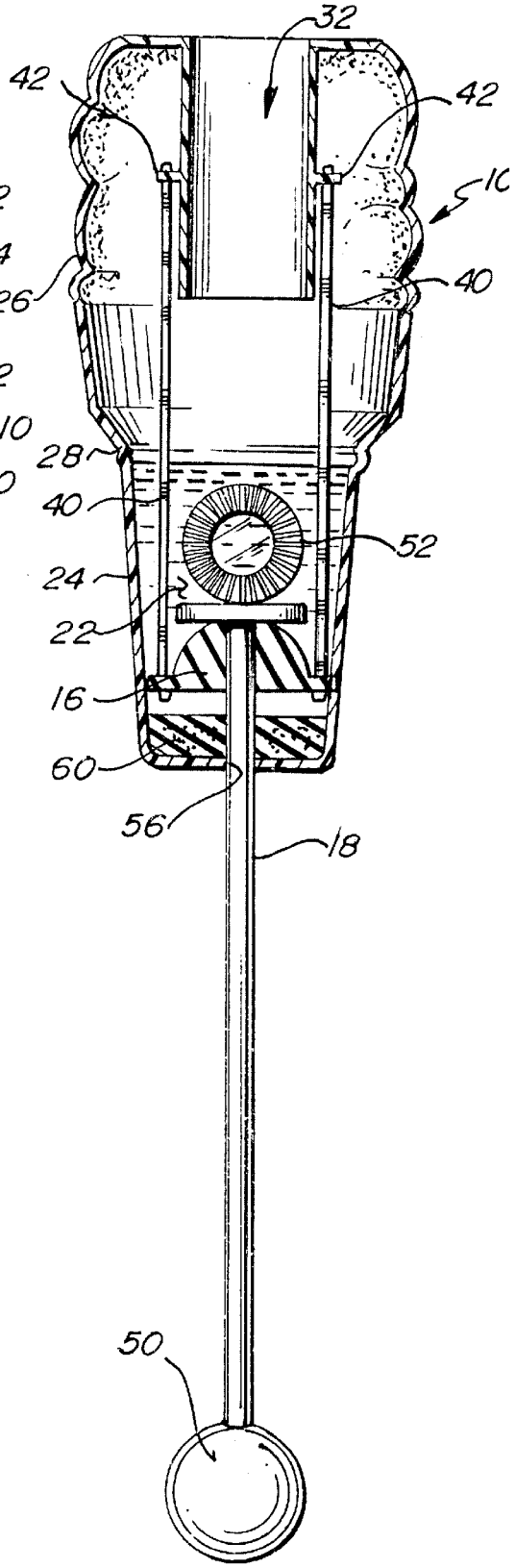
FIG. 5 is a similar view as FIGS. 1, 3 and 4 but showing the actuator mechanism lowered further so that the bubble forming ring is immersed within the bubble solution with the valve opened between the main and outer compartments.

As shown in FIG. 5, the biasing means 40 permits further manipulation of the actuator 18 so that valve 16 and bubble forming ring 52 are sufficiently lowered within the lower portion 24 of container 12 to be below the surface of bubble solution 22. In a well known manner, the bubble forming ring 52 picks up a film of bubble solution by being immersed within the bubble solution 22. In this stage, the bubble forming ring 52 is entirely within the main compartment 20.

Figure 6:
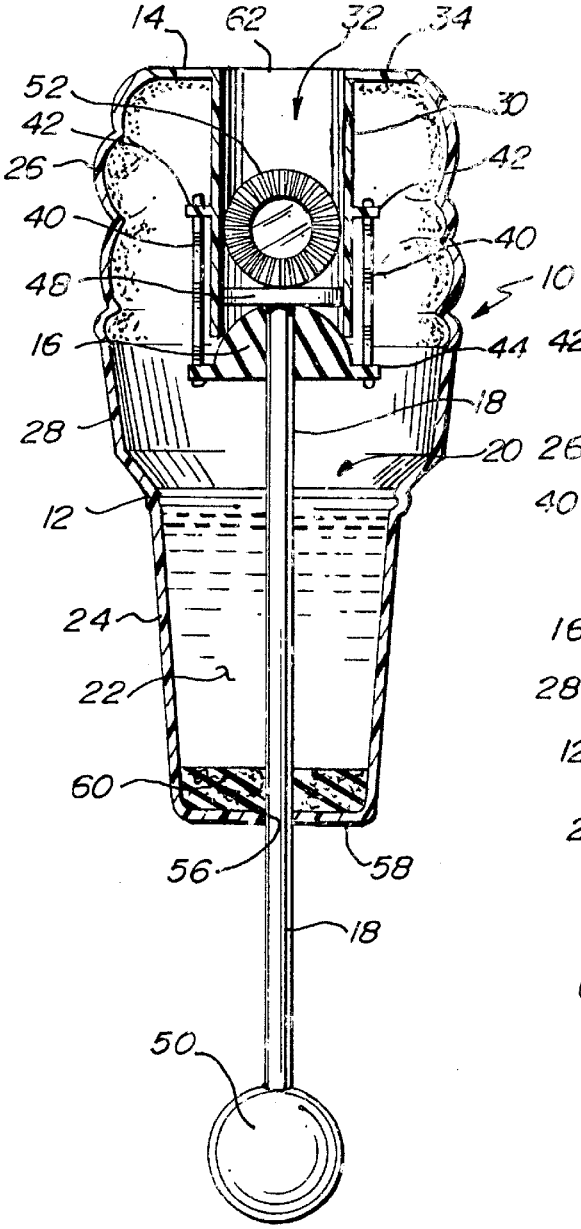
FIG. 6 is a similar view as FIGS. 1, 3, 4 and 5, but with the valve again closed between the main and outside compartments while the bubble forming ring having a film of bubble solution is positioned and thus shielded within the outer compartment.

FIG. 6 illustrates the bubble forming ring 52, repositioned within the outside compartment 32 and with valve 16 closing the outside compartment 32 from the main compartment 20. The valve returns to its closed position under the force generated by the biasing means 40 as permitted by the movement of actuator 18 through shoulder 48. A benefit of the size of the outside compartment 32, as illustrated, is that the bubble forming ring 52 can be provided entirely therein while the bubble forming ring 52 is provided with a film of bubble solution over its opening 54. Thus, the bubble forming ring 52 can be prepared or loaded with bubble solution, but protected from stray air flow that may affect or cause a bubble to be formed at an unintended time. For example, a wind gust may destroy the film of bubble solution or cause it to form at an unattended time or uncontrolled way. Then, when the operator chooses, the actuator 18 can be further manipulated so that the bubble forming ring 52 is positioned above the top surface 62 to provided easy access and control of the bubble making process by the user. Once the valve 16 is appropriately seated against the lower end 36 of the tubular portion 30, continued upward manipulation of actuator 18 is conducted unimpeded while passing through valve 16. In accordance with the present invention, the valve 16 is open only during the loading step for immersing the bubble forming ring 52 and picking up a film of bubble solution. That is, when the device is not in use, such as during storage or between uses, the bubble forming ring 52 is loaded with a film of bubble solution, and during a bubble forming process, the valve 16 is closed to reduce the possibility of spillage of bubble solution from main compartment 20. The biasing means 40 substantially renders the bubble-making toy auto-closing and spill free. The outside compartment 32 never requires any holding of a quantity of bubble solution but provides a catch volume into which any drips from the bubble forming ring 52 will fall, even when the bubble-making toy 10 is held at a substantial angle. Thus, mess and spillage potential are greatly reduced. This process can be repeated as often as desired while a sufficient quantity of solution is maintained within the main compartment 20 of container 12 The bubble solution 22 may be resupplied through the outside compartment 32 with valve 16 manipulated into an open position, or other access may be provided. For example, the divider structure 14 may be removable, the top portion 34 may include an access opening that is open or closeable by another element or other openings with or without closure elements may be provided otherwise through the container 12.

What is claimed is:

1. A spill resistant bubble-making toy comprising:

a container having a main compartment provided therein for receiving and holding a quantity of bubble solution;

a divider structure operatively supported relative to said container, said divider structure including an outside compartment defining portion having an access opening positioned to permit access between said main compartment and said outside compartment;

a valve operatively positioned for selectively opening and closing the access opening of said divider structure; and an actuator movably disposed relative to the outside compartment and including a bubble forming ring, said actuator having a first portion thereof for manipulation by a user and by which a user can move the actuator and thus the bubble forming ring and a second portion for engagement with the valve for opening the valve and permitting the bubble forming ring to be disposed within the main compartment.

2. The bubble-making toy of claim 1, wherein the valve is biased toward the outside compartment defining portion of the divider structure so that the valve closes the access opening under the biasing force.

3. The bubble-making toy of claim 2, wherein the valve further includes a passage through which the actuator passes.

4. The bubble-making toy of claim 3, wherein the outside compartment defining portion of the divider structure extends to define the outside compartment with a volume within which at least a portion of the actuator is movable.

5. The bubble-making toy of claim 4, wherein the outside compartment volume is at least partially within a volume of the container.

6. The bubble-making toy of claim 4, wherein the divider structure further comprises a top portion that supports the outside compartment defining portion and that closes the main compartment of the container.

7. The bubble-making toy of claim 6, wherein the actuator extends in the direction of its movement sufficiently so that the bubble forming ring can be positioned beyond the top portion of the divider structure, and the actuator second portion comprises a shoulder portion for engagement with the valve as the actuator is moved in a first direction, and the actuator is otherwise movable within the passage of the valve.

8. The bubble-making toy of claim 7, wherein the shoulder portion is spaced from the valve when the bubble forming ring is positioned beyond the top portion so that the shoulder engages the valve only after the actuator is moved in the first direction by a distance where at least a portion of the bubble forming ring is within the outside compartment volume.

9. The bubble-making toy of claim 8, wherein the valve is openable against the bias force of the valve by continued movement in the first direction of the actuator after engagement of the shoulder with the valve, and the valve is closeable under the influence of its bias force upon movement of the actuator in a second direction opposite to the first direction after the valve is opened.

10. The bubble-making toy of claim 9, wherein the container is sized and configured so that a quantity of bubble solution can be stored within the main compartment below the valve and outside compartment and so that the valve and bubble forming ring can be positioned within bubble solution when stored within the main compartment by movement of the actuator in the first direction.

11. The bubble-making toy of claim 10, wherein the actuator extends in the first direction so as to further pass through a passage of the container that permits the actuator to move in its first and second directions, and the first portion of the actuator is provided beyond the container passage, the actuator having a length so that the bubble forming ring can be positioned above the top portion with the first portion of the actuator beyond the container passage.

12. The bubble-making toy of claim 11, further including a wet seal provided about the container passage for permitting movement of the actuator in its first and second directions, but to provide an effective liquid seal between the actuator and container.

13. The bubble-making toy of claim 6, wherein the second portion of the actuator is frictionally engaged with the valve passage so that the valve and actuator can move together until a threshold resistance is encountered, upon which the actuator can slide relative to the valve.

14. The bubble-making toy of claim 13, wherein the threshold resistance can be provided by the bias force of the valve so that after the valve is opened by movement of the actuator and valve in the first direction, continued movement of the actuator is permitted so that the bubble forming ring can be positioned within the main compartment of the container.

15. The bubble-making toy of claim 14, wherein the container further comprises an ornamental external surface.

16. The bubble-making toy of claim 15, wherein the container is sized and shaped and its ornamental external surface includes shaped features to simulate an ice cream cone.

17. A method for making bubbles from a bubble solution by a bubble-making toy comprising the steps of:

providing a container that is divided into plural compartments including at least a main compartment having a quantity of bubble solution therein and an outside compartment that is open to outside of the container and openable and closeable to the main compartment by a valve;

providing an actuator having a first portion for manipulation by a user and a bubble forming ring;

manipulating the actuator to move the bubble forcing ring in a first direction from the outside compartment to within the main compartment after opening the valve;

immersing the bubble forming ring within the bubble solution while the valve is open for picking up a film of bubble solution on the bubble forming ring;

further manipulating the actuator to move the bubble forming ring in a second direction that is opposite to the first direction from within the bubble solution in the main compartment, through the outside compartment and from the container for access to a user;

closing the valve; and directing a fluid flow toward the bubble forming ring.

18. The method of claim 17, wherein the step of manipulating the actuator to move the bubble forming ring within the main compartment comprises the actuator engaging the valve and then opening the valve by continued movement of the actuator in the first direction, and after such engagement, moving the bubble forming ring into the main compartment by the continued actuator movement in the first direction.

19. The method of claim 18, wherein the step of manipulating the actuator to move the bubble forming ring within the main compartment further comprises moving the actuator relative to the valve for a distance in the first direction before a second portion of the actuator engages with the valve.

20. The method of claim 19, wherein the bubble forming ring is moved to be positioned within the outside compartment before the valve is opened.

21. The method of claim 20, wherein the bubble forming ring is moved to be positioned within the main compartment by the actuator opening the valve against a bias force that urges the valve to a closed position of the outside compartment to the main compartment.

22. The method of claim 21, wherein the bubble forming ring is moved back into the outside compartment after it is immersed in bubble solution by moving the actuator in the second direction and after the valve is closed under the influence of the bias force.

23. The method of claim 22, where continued movement of the bubble forming ring from the outside compartment after it is immersed occurs while the valve is kept in a closed position.

24. The method of claim 19, wherein the step of providing an actuator further comprises providing the actuator to extend through a passage of the valve and permitting at least a limited movement of the actuator to the valve in the first and second directions.

25. The method of claim 24, wherein the step of providing an actuator further comprises providing the actuator to extend through a passage of a portion of the container below the bubble solution and permitting at least a limited movement of the actuator to the container in the first and second directions but effectively preventing bubble solution leakage so that the actuator can be manipulated from outside the container.

* * * * *